US008563924B2

(12) United States Patent
Cooley et al.

(10) Patent No.: US 8,563,924 B2
(45) Date of Patent: Oct. 22, 2013

(54) WINDOWLESS IONIZATION DEVICE

(75) Inventors: James Edward Cooley, San Francisco, CA (US); Sameer Kothari, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 294 days.

(21) Appl. No.: 13/170,282

(22) Filed: Jun. 28, 2011

(65) Prior Publication Data

US 2013/0001416 A1 Jan. 3, 2013

(51) Int. Cl.
*H01J 49/00* (2006.01)

(52) U.S. Cl.
USPC ..... 250/288; 250/287; 250/428; 250/423 R; 250/423 P; 250/424; 250/503.1; 250/504 R; 315/111.01; 315/111.21; 313/231.01; 313/231.31; 313/231.71; 313/231.61; 313/618; 313/631; 313/632

(58) Field of Classification Search
USPC ..... 250/288, 287, 428, 423 R, 423 P, 424, 250/503.1, 504 R; 315/111.01, 111.21; 313/231.01, 231.31, 231.71, 231.61, 313/618, 631, 632
See application file for complete search history.

(56) References Cited

U.S. PATENT DOCUMENTS

| | | | | |
|---|---|---|---|---|
| 4,476,392 | A | 10/1984 | Young | |
| 5,481,107 | A | 1/1996 | Takada et al. | |
| 7,332,715 | B2 | 2/2008 | Russ, IV et al. | |
| 7,618,806 | B2 | 11/2009 | Reilly et al. | |
| 2008/0296485 | A1 | 12/2008 | Benter et al. | |
| 2009/0121127 | A1 | 5/2009 | Orlando et al. | |
| 2010/0032559 | A1* | 2/2010 | Lopez-Avila et al. | 250/282 |
| 2011/0109226 | A1* | 5/2011 | Cooley et al. | 315/111.21 |

OTHER PUBLICATIONS

International Search Report mailed Jan. 17, 2013 for Application No. PCT/US2012/040407.

* cited by examiner

*Primary Examiner* — Jack Berman
*Assistant Examiner* — Meenakshi Sahu

(57) ABSTRACT

An ionization device comprises: a plasma source configured to generate a plasma. The plasma comprises light, plasma ions and plasma electrons. The plasma source comprises an aperture disposed such that at least part of the light passes through the aperture and is incident on a gas sample. The ionization device further comprises an ionization region; and a plasma deflection device comprising a plurality of electrodes configured to establish an electric field, wherein the electric field substantially prevents the plasma ions from entering the ionization region.

20 Claims, 8 Drawing Sheets

WINDOWLESS IONIZATION DEVICE

BACKGROUND

Electromagnetic energy may be employed to facilitate examination of the composition of an unknown gas via photochemistry applications such as soft ionization and photofragmentation. The vacuum ultraviolet (VUV) region of the electromagnetic spectrum is particularly useful in these applications because the energies of VUV photons (generally 6-124 eV) correspond to electronic excitation and ionization energies of most chemical species. Vacuum ultraviolet (VUV) light is generally defined as light having wavelengths in the range of 10-200 nanometers.

Most existing systems involve generating VUV light remotely from the area to be exposed, for example using a resonance lamp, frequency-multiplied laser, or synchrotron, and attempting to deliver this light to the area of interest, typically by passing the VUV light through a window. However, window materials and refractive optics in this wavelength range are scarce or non-existent, so it is often impractical to direct or concentrate VUV light. The windows that are employed typically absorb a large fraction of light in this wavelength spectrum, and reflective optics can become contaminated in a less-than perfectly clean environment. In addition, lasers and synchrotrons can be prohibitively expensive and can require large amounts of power and space.

So-called "windowless" photoionization devices ("ionization devices") allow a greater portion of the light spectrum to be incident on a sample. However, in known windowless ionization devices, positive ions of the plasma ("plasma ions") and electrons of the plasma ("plasma electrons") can travel through the aperture through which the light of the plasma is desirably transmitted. The presence of the plasma ions in the ionization region can result in interfering peaks with analyte ions of the sample, and ultimately reduce the reliability of the detection of analyte ions of interest. Plasma electrons and ions can undesirably give rise to hard ionization of the analyte ions of the sample in an uncontrolled manner, either through electron impact ionization or ion-molecule charge transfer reactions.

What is needed, therefore, are better systems and methods of generating VUV light and delivering the VUV light to an area of interest.

SUMMARY

In accordance with a representative embodiment, an ionization device comprises: a plasma source configured to generate a plasma. The plasma comprises light, plasma ions and plasma electrons. The plasma source comprises an aperture disposed such that at least part of the light passes through the aperture and is incident on a gas sample. The ionization device further comprises an ionization region; and a plasma deflection device comprising a plurality of electrodes configured to establish an electric field, wherein the electric field substantially prevents the plasma ions from entering the ionization region.

In accordance with another representative embodiment, method of exposing a sample gas to an excitation light is disclosed. The method comprises: generating a plasma comprising light, plasma ions and plasma electrons; passing at least a portion of the light from the plasma through an aperture to an ionization region; passing a gas sample through the ionization region; and generating an electric field to substantially prevent the plasma ions from entering the ionization region.

In accordance with another representative embodiment, an ionization device, comprises: a channel having an inlet end and an outlet end, the inlet end being configured to receive a gas sample; a plasma source configured to generate light, plasma ions and plasma electrons, the plasma source comprising an aperture disposed such that at least part of the light passes through the aperture and is incident on the gas sample released from the outlet end of the channel; and a plurality of electrodes configured to establish an electric field to guide plasma ions. The electric field substantially prevents the plasma ions from exiting through the aperture. The ionization device comprises a magnet configured to establish a magnetic field to guide plasma electrons. The magnetic field substantially prevents the plasma electrons of the plasma from exiting through the aperture and the electric field and the magnetic field are orthogonal.

BRIEF DESCRIPTION OF THE DRAWINGS

The representative embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

Figure 1:
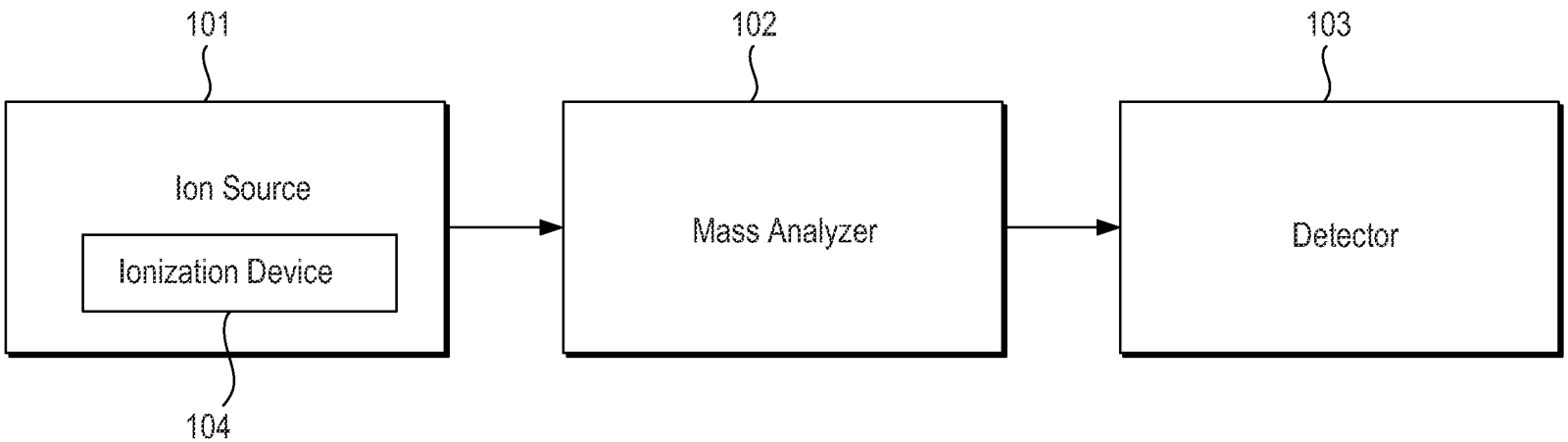
FIG. 1 illustrates a simplified schematic view of a mass spectrometer in accordance with a representative embodiment.

In the following detailed description, for purposes of explanation and not limitation, representative embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

An effective strategy for irradiating gas samples for photochemistry applications is to produce a high density light in a geometry that is convenient for coupling to the flow of a sample gas. Described below are representative embodiments of an ionization device that allows for efficient coupling of photons of a desired wavelength (e.g., vacuum ultraviolet (VUV) light) to a flowing gas sample.

In a representative embodiment, a plasma is created in a structure and an aperture in the structure allows for windowless emission of photons (e.g., VUV photons) that are incident on sample ions in an ionization region. A plasma deflection device is provided between the aperture and the ionization region. The plasma deflection device comprises deflection electrodes, which generate a static electric field in the region between the aperture and the ionization region. The electric field deflects (through attraction or repulsion) positive ions of the plasma that traveled through the aperture and substantially prevents these ions from reaching the ionization region. In an embodiment, the plasma deflection device also comprises magnets, which generate a static magnetic field in the region between the aperture and the ionization region. The static magnetic field substantially prevents electrons from reaching the ionization region. The magnitude of the magnetic field is great enough to influence the motion of plasma electrons, but not great enough to influence the motion of plasma ions, which are comparatively massive.

The magnetic field may be oriented orthogonal to the electric field, or parallel to the electric field. As described more fully below, with the magnetic field oriented orthogonal to the electric field the plasma electrons that travel through the aperture drift in a direction that is orthogonal to both the electric field and the magnetic field in a so-called E X B (where "X" designates the cross product) drift. Orientation of the magnetic field is selected so that the plasma electrons do not drift into the ionization region. With the magnetic field oriented parallel (or anti-parallel) to the electric field, plasma electrons that travel through the aperture are subjected to the Lorentz force. Orientation of the magnetic field is selected so that the plasma electrons are deflected away from the ionization region.

In another representative embodiment, a plasma is created in a toroidal cavity constructed with an aperture oriented along an inner surface or wall thereof that allows for windowless emission of photons (e.g., VUV photons) directed radially inward to the flowing gaseous sample. In accordance with representative embodiments, static electric and magnetic fields create a plasma from a source gas. In accordance with representative embodiments, the electric and magnetic fields are orthogonal everywhere in the ionization device. This causes a drift of the plasma electrons in the direction of the cross-product of the electric field vector and the magnetic field vector (E X B). As a result of the EXB drift, movement of the plasma electrons is the superposition of a relatively fast circular motion around a point (commonly referred to as the guiding center) and a relatively slow drift of this point in circular motion according to the geometries of the ionization device. By contrast, due to their relatively large mass and the selection of a comparatively weak static magnetic field, the plasma ions are not significantly influenced by EXB drift but rather accelerate axially in the static electric field. As described more fully below, the orientation and magnitude of the static electric and magnetic fields according to the representative embodiments aids in preventing plasma ions and plasma electrons from being directed into the ionization region of the ionization device.

FIG. 1 shows a simplified schematic diagram of a mass spectrometer 100 in accordance with a representative embodiment. The block diagram is drawn in a more general format because the present teachings may be applied to a variety of different types of mass spectrometers. As should be appreciated as the present description continues, devices and methods of representative embodiments may be used in connection with the mass spectrometer 100. As such, the mass spectrometer 100 is useful in garnering a more comprehensive understanding of the functions and applications of the devices and method of the representative embodiments, but is not intended to be limiting of these functions and applications. The mass spectrometer 100 comprises an ion source 101, a mass analyzer 102 and a detector 103. The ion source 101 comprises an ionization device 104, which is configured to ionize a gas sample (not shown in FIG. 1) and to provide ions to the mass analyzer 102. Details of ionization device 104 are described in accordance with representative embodiments below. Other components of the mass spectrometer 100 comprise apparatuses known to one of ordinary skill in the art and are not described in detail to avoid obscuring the description of representative embodiments. For example, the mass analyzer 102 may be a quadrupole mass analyzer, an ion trap mass analyzer, or a time-of-flight (TOF) mass analyzer, among others.

Figure 2A:
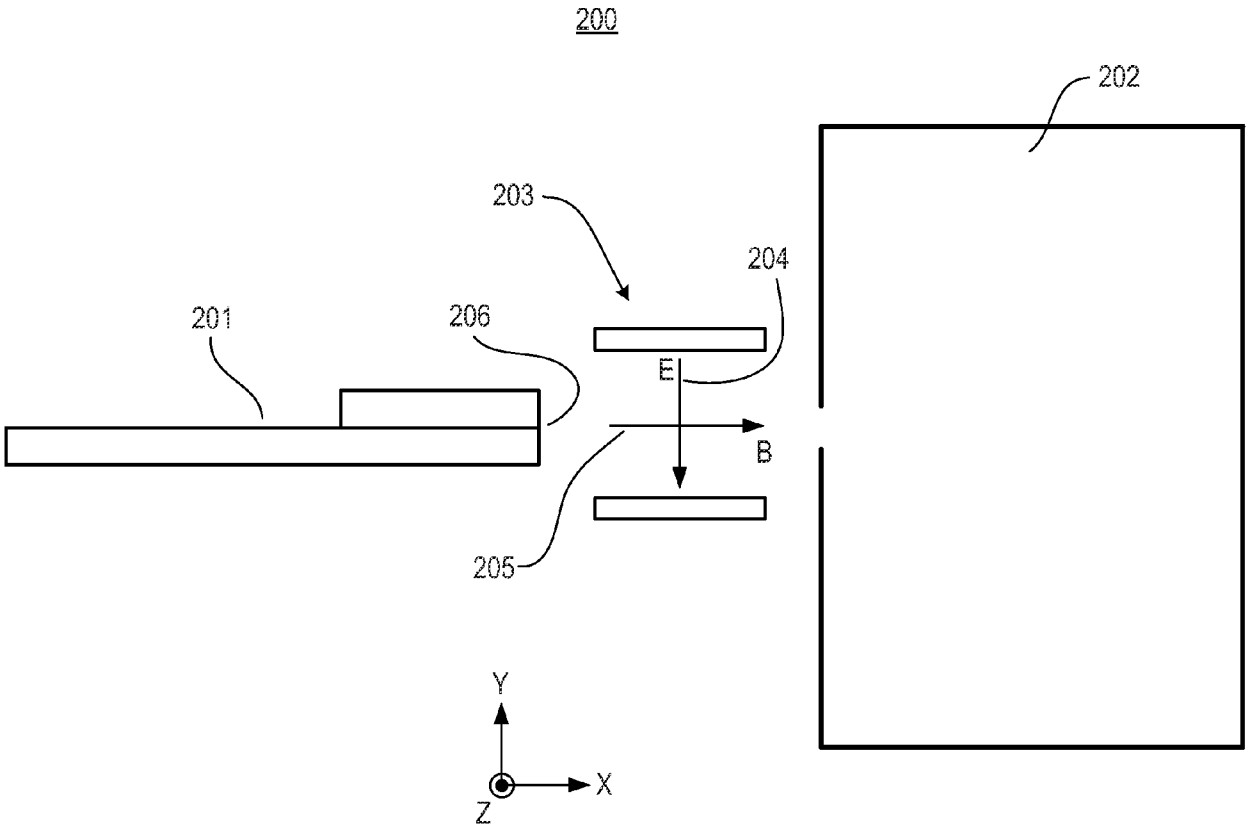
FIG. 2A illustrates a simplified schematic view of an ionization device in accordance with a representative embodiment.

FIG. 2A illustrates a simplified schematic view of an ionization device 200 in accordance with a representative embodiment. The ionization device 200 may be implemented in the ion source 101 as the ionization device 104. The ionization device 200 comprises a plasma source 201, an ionization region 202 and a plasma deflection device 203 disposed between the plasma source 201 and the ionization region 202. As described more fully below, the plasma deflection device 203 comprises plasma ion deflection electrodes (not shown in FIG. 2A), which generate a static electric field 204. Notably, a power source (not shown) is connected between the plasma deflection electrodes and an electrostatic voltage is applied between the plasma deflection electrodes to establish the static electric field. The static electric field deflects (repels or attracts) plasma ions and plasma electrons away from the ionization region 202. Optionally, a source of a static magnetic field 205 is provided to deflect plasma electrons away from the ionization region 202. In certain embodiments the source may be a permanent magnet, and in other embodiments, the source may be an electromagnet.

Light from the plasma source 201 is emitted through an aperture (not shown in FIG. 2A) at an end 206 of the plasma source 201 and is incident on analyte molecules of a sample (not shown) in the ionization region 202. The light ionizes the analyte molecules, which are then provided to mass analyzer 102 of mass spectrometer 100. In accordance with a representative embodiment, the plasma source 201 may be as described in commonly-owned U.S. patent application Ser. No. 12/613,643, entitled "Microplasma Device with Cavity for Vacuum Ultraviolet Irraditation of Gases and Methods of Making and Using the Same" to James E. Cooley, et al. The disclosure of this patent application, which is published as U.S. Patent Application Publication 20110109226, is specifically incorporated herein by reference.

Plasma ions and plasma electrons may undesirably be emitted through the aperture at the end 206 of the plasma source 201. As noted above, it is undesirable for plasma ions and plasma electrons to enter the ionization region 202. In a representative embodiment, the plasma ions that are emitted at the end 206 are deflected by the static electric field 204 in a direction away from the ionization region (y-direction in the coordinate system of FIG. 2A), and plasma electrons are deflected in an opposite direction by the static electric field 204.

Plasma ions and plasma electrons that are emitted from the aperture at the end 206 of the plasma source 201 and can form a quasi-neutral, plasma-like environment. Formation of such a quasi-neutral plasma-like environment in close proximity to the deflection electrodes of the plasma deflection device 203 can serve to screen the static electric field 204 and diminish its influence on the plasma ions. If the length over which plasma ions and plasma electrons effectively screen the electrostatic potential applied to the deflection electrodes of the plasma deflection device 203 is less than the distance between the deflection electrodes, the usefulness of the static electric field 204 in preventing plasma ions from reaching the ionization region 202 is undesirably diminished.

In a representative embodiment, static electric field 204 is provided in the plasma deflection device 203. Plasma ions are influenced by the static electric field 204 and are deflected away from the ionization region. For example, with the illustrative orientation of the static electric field 204 as depicted in FIG. 2A, the plasma ions are directed in the y-direction. The plasma ions are comparatively massive, and the magnitude of the static magnetic field 205 is selected so that the motion of plasma ions is not significantly impacted by the static magnetic field 205. However, plasma electrons are subjected to E X B drift and are deflected in the z direction (i.e., out of the plane of the page) in the coordinate system depicted in FIG. 2A. As such, application of the static electric field 204 and the static magnetic field 205 in the plasma deflection device 203 as depicted in FIG. 2A allows for the separation of the plasma ions and plasma electrons, thereby preventing the formation of the quasi-neutral plasma-like environment at the end 206 of the plasma source 201, and ultimately improved deflection of plasma ions and plasma electrons away from the ionization region 202.

Figure 2B:
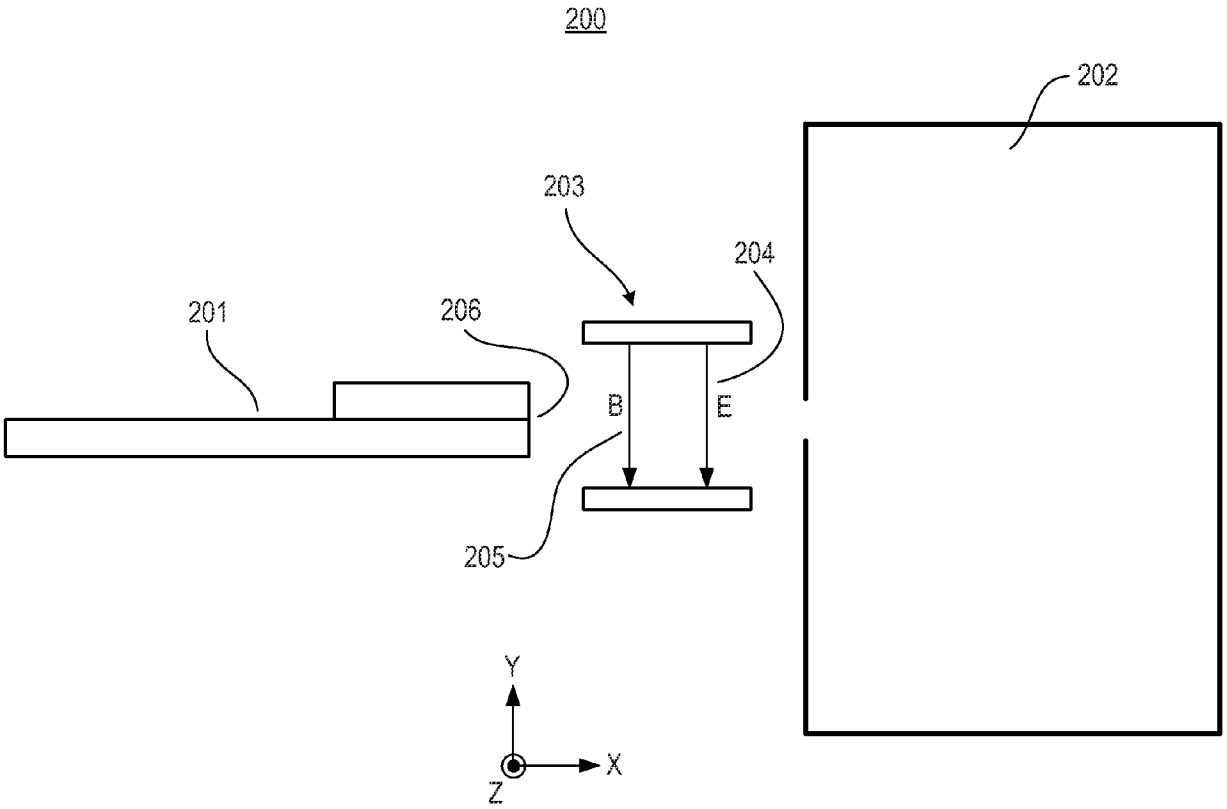
FIG. 2B illustrates a simplified schematic view of an ionization device in accordance with a representative embodiment.

FIG. 2B illustrates a simplified schematic view of an ionization device 200 in accordance with another representative embodiment. The ionization device 200 may be implemented in the ion source 101 as the ionization device 104. The ionization device 200 comprises plasma source 201, ionization region 202 and plasma deflection device 203 disposed between the plasma source and the ionization region. The plasma deflection device 203 comprises plasma ion deflection electrodes (not shown). As described more fully below, the plasma deflection device 203 comprises plasma ion deflection electrodes (not shown in FIG. 2B), which generate a static electric field 204. Notably, a power source (not shown) is connected between the plasma deflection electrodes and an electrostatic voltage is applied between the plasma deflection electrodes to establish the static electric field. The static electric field deflects plasma ions and plasma electrons away from the ionization region 202. Optionally, a source of a static magnetic field 205 is provided to deflect plasma electrons away from the ionization region 202. In certain embodiments the source may be a permanent magnet, and in other embodiments, the source may be an electromagnet.

In the presently described embodiment, the static electric field 204 and the static magnetic field 205 are oriented parallel to one another. It is contemplated that the static electric field 204 and the static magnetic field 205 are oriented anti-parallel to one another.

Plasma ions are influenced by the static electric field 204 and are deflected away from the ionization region (again in the y-direction). Plasma electrons having a velocity component orthogonal to the static magnetic field 205 are subjected to a magnetic component (q v X B) of the Lorentz force (q(E+vXB)), where v is the velocity of the electron, q is the charge of the electron, E is the electric field and B is the magnetic field. The magnetic component beneficially retards the motion of the plasma electrons in the x-direction. Ultimately, a significant portion of the plasma electrons that are emitted from the end 206 of the plasma source 201 are deflected away from the ionization region by the plasma deflection device 203. As such, application of the static electric field 204 and the static magnetic field 205 in the plasma deflection device 203 as depicted in FIG. 2B allows for the separation of the plasma ions and plasma electrons, thereby preventing the formation of the quasi-neutral plasma-like environment at the end 206 of the plasma source 201, and ultimately improves deflection of plasma ions and plasma electrons away from the ionization region 202.

Figure 3A:
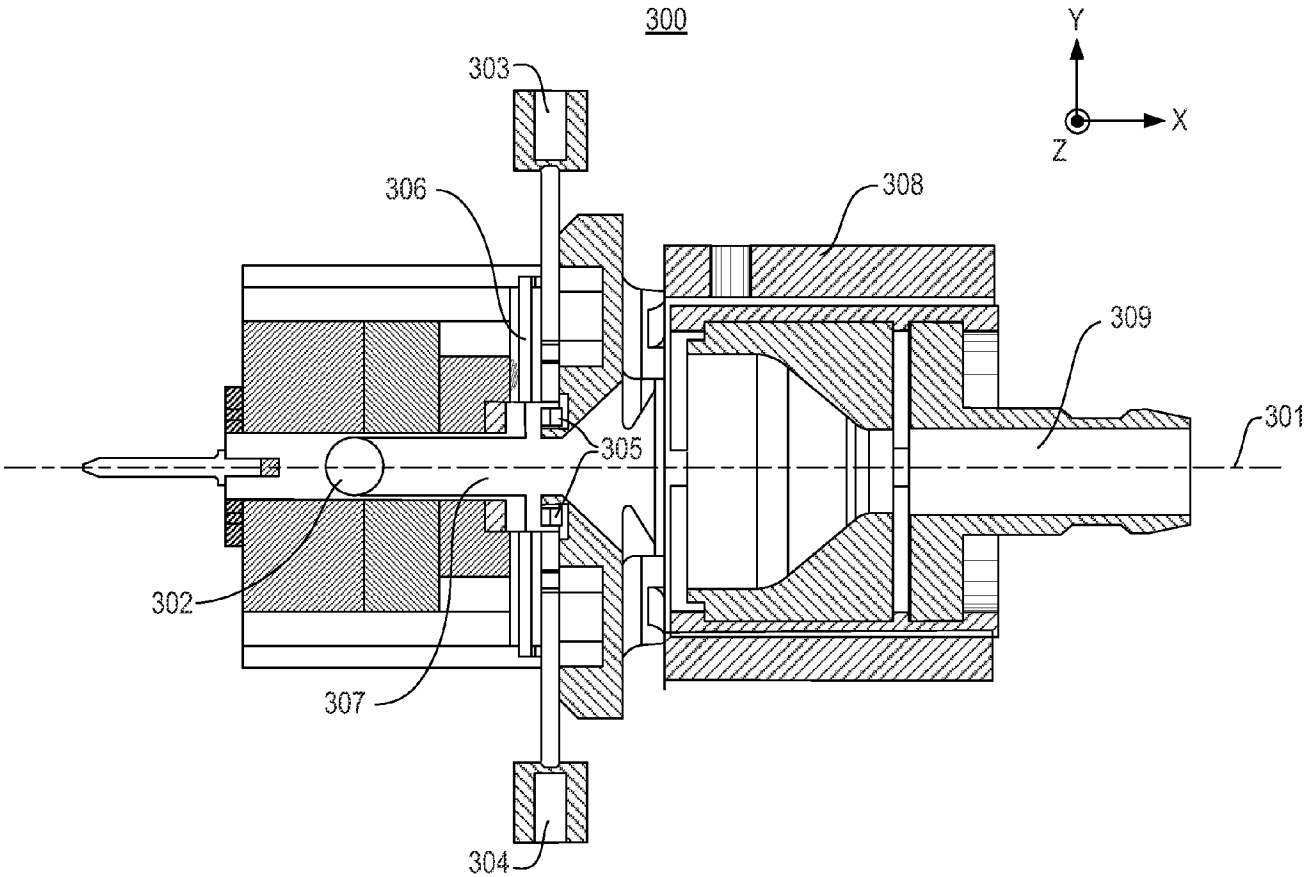
FIG. 3A illustrates a cross-sectional view of an ionization device in accordance with a representative embodiment.

FIG. 3A illustrates a cross-sectional view of an ionization device 300 in accordance with a representative embodiment. The ionization device 300 may be implemented in the ion source 101 as the ionization device 104. The ionization device 300 is disposed around an axis of symmetry 301. An inlet 302 is provided and is configured to receive a sample gas (not shown) comprising analyte molecules. The sample gas is directed at the inlet 302 in a direction parallel to the axis of symmetry 301.

The various components of the ionization device 300 that are usefully electrically conducting are made of a suitable electrically conductive material such as stainless steel. The various components of the ionization device 300 that are required to be electrically insulating are made of a suitable electrical insulator such as a high-temp plastic (e.g., Vespel®), or a suitable machinable ceramic material (e.g., Macor®, alumina or boron nitride). The magnets of the representative embodiments are illustratively rare-earth magnets, known to one of ordinary skill in the art.

The ionization device 300 comprises a first plasma source 303 and, optionally, a second plasma source 304. The first and second plasma sources 303, 304 are illustratively as described in U.S. Patent Application Publication 20110109226, incorporated by reference above. Notably, the second plasma source 304 provides redundant function to the first plasma source 303 and its function is not described in further detail.

The ionization device 300 comprises a deflection device 305 disposed adjacent to an aperture (not shown in FIG. 3A) through which light from a plasma 306 is transmitted. The light from the plasma is incident on the sample gas in an ionization region 307. After ionization, analyte ions are directed by ion optics 308 toward an outlet 309 and to a mass analyzer (not shown in FIG. 3A). As described above, and more fully below in connection with the present embodiment, the deflection device 305 is configured to provide a static electric field, and optionally, a static magnetic field. The static electric field is generally established by creating a voltage difference between approximately 10V and 100 V between deflection electrodes described below. As noted above, the magnetic field strength is selected to deflect plasma electrons, but not plasma ions, which have a greater mass than the plasma electrons. For example, the static magnetic field is approximately 5000 Gauss.

In certain embodiments, the electric field is orthogonal to the magnetic field. As such, plasma ions are influenced by the static electric field and are deflected away from the ionization region 307. The plasma electrons are subjected to E X B drift and are deflected in the z direction (i.e., out of the plane of the page) in the coordinate system depicted in FIG. 3A.

In other embodiments, the static electric field is parallel (or antiparallel) to the static magnetic field. Plasma ions are influenced by the static electric field and are deflected away from the ionization region 307. Plasma electrons having a velocity component orthogonal to the static magnetic field are subjected to a magnetic component of the Lorentz force and are deflected away from the ionization region.

Figure 3B:
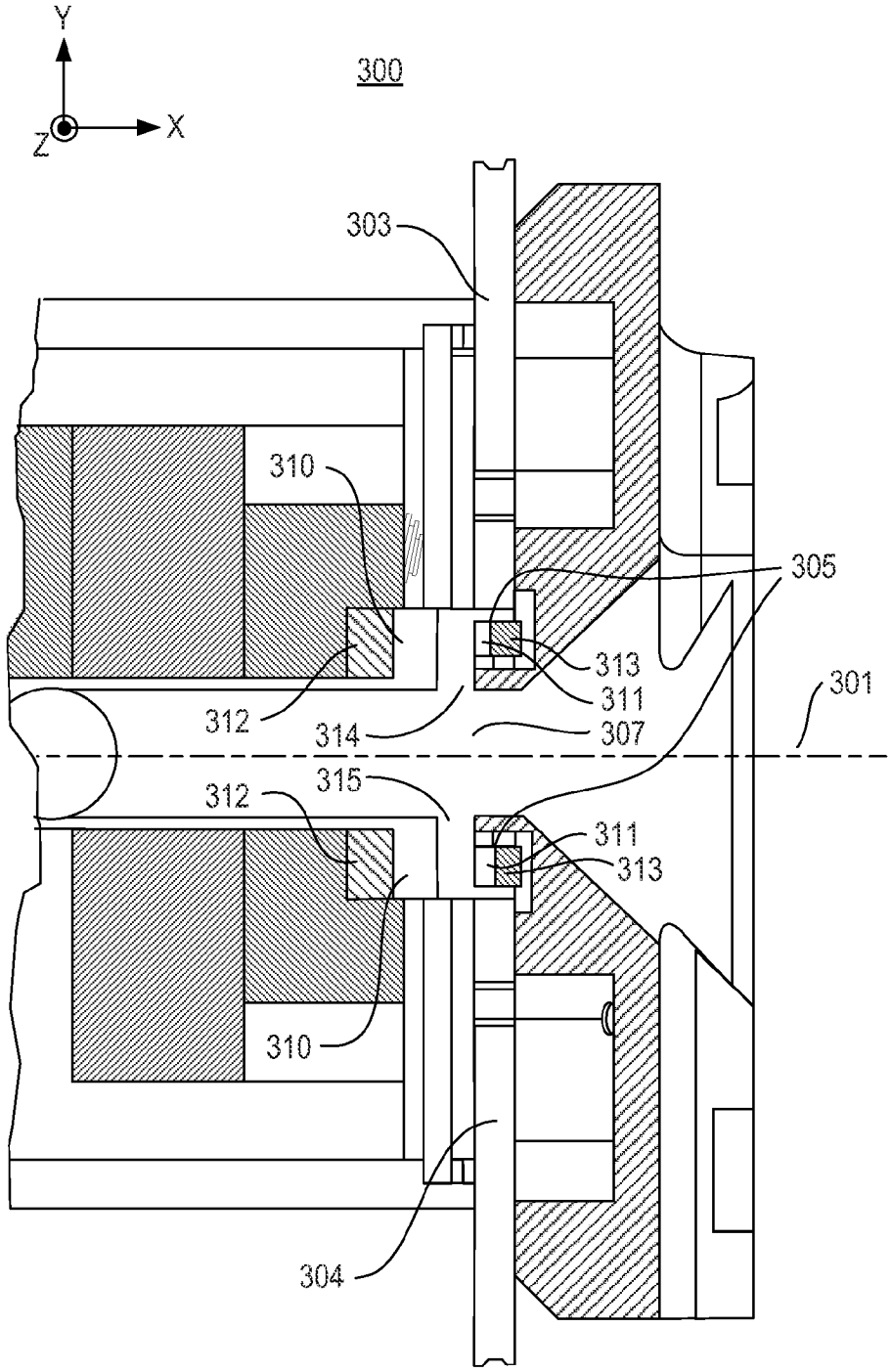
FIG. 3B illustrates an enlarged portion of the ionization device depicted in FIG. 3A.

FIG. 3B illustrates an enlarged portion of the ionization device 300 depicted in FIG. 3A. Notably, FIG. 3B depicts the deflection device 305 in greater detail. The deflection device 305 comprises a first deflection electrode 310 and a second deflection electrode 311. In certain embodiments, the first and second deflection electrodes 310, 311 are disposed to create an electric field that deflects plasma ions and plasma electrons from both the first plasma source 303 and the second plasma source 304 and substantially prevents the plasma ions and plasma electrons from reaching the ionization region 307. In the illustrative embodiment, the first and second deflection electrodes 310, 311 establish respective electric fields oriented in the x-dimension to substantially deflect plasma ions and plasma electrons from traveling in the z-direction and into the ionization region 307.

The deflection device 305 optionally comprises a first magnet 312 and a second magnet 313. The first and second magnets 312, 313 are of opposite polarity and create a radial magnet field. The first and second magnets 312, 313 may comprise permanent magnets or electromagnets known to one of ordinary skill in the art. Like the first and second deflection electrodes 310, 311, the first and second magnets 312, 313 are disposed annularly around the axis of symmetry 301 so that each of the first and second magnets 312, 313 deflect plasma electrons from both the first plasma source 303 and the second plasma source 304.

A first aperture 314 is provided between the first plasma source 303 and the ionization region 307, and a second aperture 315 is disposed between the second plasma source 304 and the ionization region 307. In a representative embodiment, the first and second apertures 314, 315 are approximately 600 μm in width (z-direction in the depicted coordinate system) and approximately 250 μm in height (x-direction in the depicted coordinate system). The first and second deflection electrodes 310, 311 are separated (in the x-direction) by approximately 1.0 mm, and the ionization region 307 has a radius (in the y-z plane) of approximately 3.0 mm It is noted that the absolute dimensions of the components and their spacing is merely illustrative. However, the scale of the dimensions is controlled to ensure suitably sufficient field strengths needed to ensure deflection of ions and electrons away from the ionization region 307.

The first and second apertures 314, 315 provide windowless illumination of the sample gas by the light from the generated plasmas. Plasma ions and plasma electrons can traverse the first and second apertures 314, 315 and travel vertically (−y direction and y direction, respectively, in the coordinate system of FIG. 3B). If plasma ions and plasma electrons are not deflected, the plasma ions and plasma electrons will enter the ionization region 307 and contaminate the sample gas as described above. In the region adjacent to the first and second apertures 314, 315, the first and second deflection electrodes 310, 311 are configured to establish a static electric field in the x-direction to deflect the plasma ions and plasma electrons in a direction away from the ionization region 307 (i.e., in the ±x direction). Beneficially, incorporation of first and second deflection electrodes 310, 311, and first and second magnets, plasma ion current in the ionization region 307 is reduced by a factor of 1000 compared to a known ionization device.

In certain embodiments the first and second magnets 312, 313 are configured to provide the static magnetic field that is orthogonal to the direction of the static electric field established between the first and second deflection electrodes 310, 311. As such, in the coordinate system depicted FIG. 3B, static magnetic field is in the −y-direction. Electrons traveling in the −y direction (i.e., from first plasma source 303 toward the ionization region 307) are deflected in the −z direction (into the plane of the page) by EXB drift. Similarly, electrons traveling in the +y direction (i.e., from second plasma source 304 toward the ionization region 307) are deflected in the +z direction (out of the plane of the page) by EXB drift. Beneficially, the plasma ions and plasma electrons are deflected away from the ionization region 307 and are substantially prevented from contaminating the sample gas. Beneficially, through incorporation of first and second deflection electrodes 310, 311, and first and second magnets 312, 313, plasma ion current and plasma electron current in the ionization region 307 are each reduced by a factor of 1000 compared to a known ionization device.

In certain embodiments the first and second magnets 312, 313 are configured to provide the static magnetic field that is parallel (or antiparallel) to the direction of the static electric field established between the first and second deflection electrodes 310, 311. As such, in the coordinate system depicted FIG. 3B, static magnetic field is in the x-direction. Electrons traveling in the −y direction (i.e., from first plasma source 303 toward the ionization region 307) are deflected in the z direction (out of the plane of the page) by magnetic component of the Lorentz force. Similarly, electrons traveling in the +y direction (i.e., from second plasma source 304 toward the ionization region 307) are deflected in the +z direction (into the plane of the page) by magnetic component of the Lorentz force. Beneficially, through incorporation of first and second deflection electrodes 310, 311, and first and second magnets 312, 313, plasma ion current and plasma electron current in the ionization region 307 are each reduced by a factor of 1000 compared to a known ionization device.

Figure 4A:
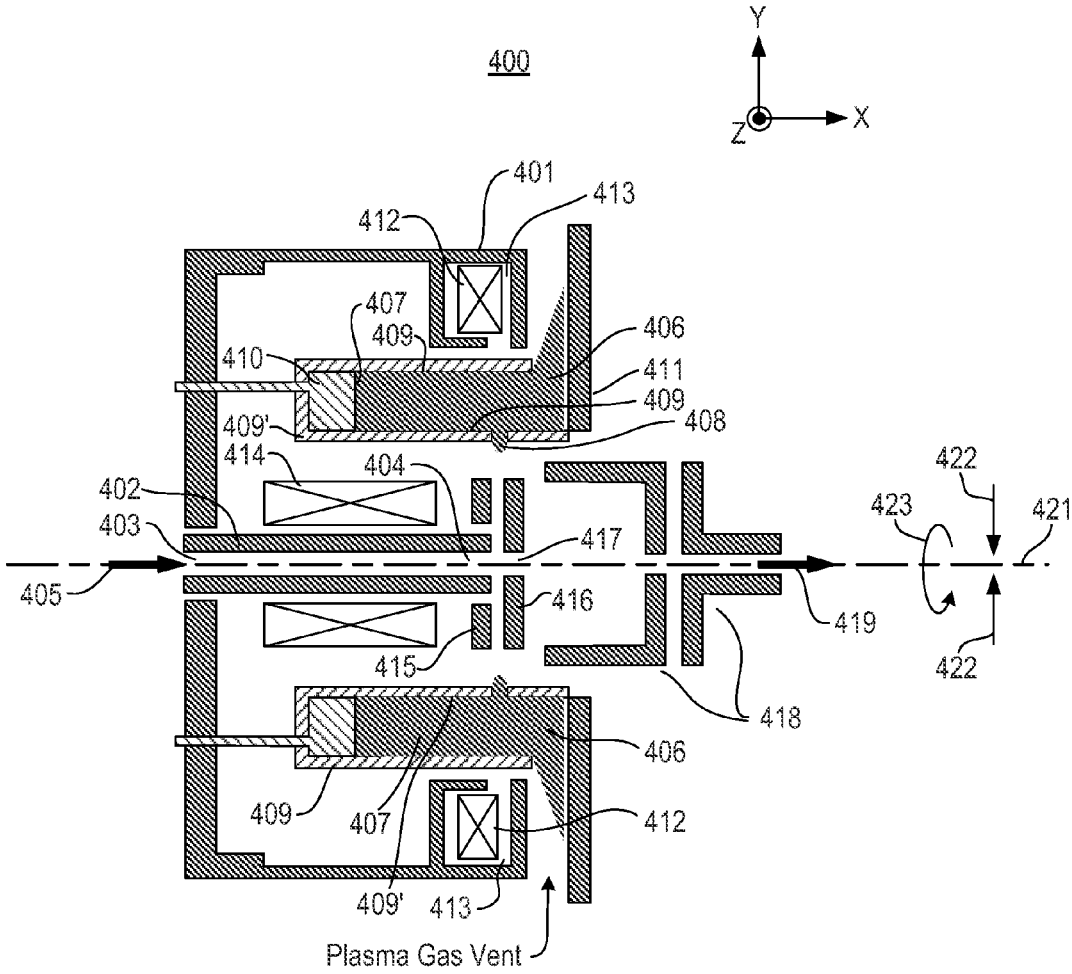
FIG. 4A illustrates a cross-sectional view of an ionization device in accordance with a representative embodiment.

FIG. 4A illustrates a cross-sectional view of an ionization device 400 in accordance with a representative embodiment. The ionization device 400 may be implemented in the ion source 101 as the ionization device 104. The ionization device 400 comprises a housing 401 configured to receive a channel 402. The channel 402 comprises an inlet 403 and an outlet 404. A gas sample 405 is provided at the inlet 403. The various components of the ionization device 400 that are usefully electrically conducting are made of a suitable electrically conductive material such as stainless steel. The various components of the ionization device 400 that are required to be electrically insulating are made of a suitable electrical insulator such as a high-temp plastic (e.g., Vespel®), or a suitable machinable ceramic material (e.g., Macor®, alumina or boron nitride). The magnets of the representative embodiments are illustratively rare-earth magnets, known to one of ordinary skill in the art.

A plasma 406 is created in a cavity 407, which substantially encircles the channel 402. The cavity 407 is formed in a structure 409, which comprises an aperture 408 along an inner wall 409' of the structure. As described more fully below, the aperture 408 along inner wall 409' allows photons (e.g., VUV photons) created in the plasma 406 to be incident on the gas sample 405 at the outlet 404 of the channel 402 and to cause photoionization of the gas sample 405.

A plasma anode 410 is disposed at one end of the cavity 407 and a plasma cathode 411 is disposed at the opposing end of the cavity 407. An outer magnet 412 is provided in a recess 413 of the housing 401 and substantially encircles the cavity 407. An inner magnet 414 substantially encircles the channel 402 as depicted. Notably, the outer and inner magnets 412, 414 are of opposite polarity and create a radial magnet field. The outer and inner magnets 412,414 may comprise permanent magnets or electromagnets known to one of ordinary skill in the art. In a representative embodiment, the outer and inner magnets 412, 414 provide a field strength in the range of 2000 Gauss to approximately 10000 Gauss.

An optional plasma electron deflection electrode 415 is disposed near the outlet 404 of the channel 402. The plasma electron deflection electrode 415 substantially encircles the channel 402 near the outlet 404 as depicted in FIG. 4A. An optional plasma ion deflection electrode 416 is disposed near the outlet 404 of the channel with an ionization region 417 formed between the outlet 404 of the channel 402 and the plasma ion deflection electrode 416. As described more fully below, the plasma electron deflection electrode 415 and the plasma ion deflection electrode 416 may be foregone due to confinement of the plasma ions and plasma electrons in the cavity 407 by the established electric and magnetic fields used to create plasma 406. In a representative embodiment, a voltage in the range of approximately 30V and approximately 120V is provided between the plasma electron deflection electrode 415 and the plasma ion deflection electrode 416 to establish the requisite static electric field therebetween.

Ion extraction optics 418 are provided adjacent to the plasma ion deflection electrode 416. An ionized gas sample 419 is provided at an exit 420 of the ionization device 400. In mass spectrometer 100, the exit 420 is connected to the mass analyzer 102. In a representative embodiment, suitable voltage differences are maintained between the ion extraction optics to ensure movement of the ions from ionization region 417 and the mass analyzer 102.

The ionization device 400 is disposed about an axis of symmetry 421, which defines an axial direction of the present teachings. As described below, an electrostatic voltage difference is established between the plasma anode 410 and the plasma cathode 411 in the axial direction. A magnetic field is established by the outer and inner magnets 412, 414 in an inward radial direction (i.e., orthogonal to the axial direction) as depicted by arrows 422 in FIG. 4A.

An inlet port (not shown in FIG. 4A) is connected to cavity 407 and is configured to receive a source gas (not shown) for generating plasma 406. In some embodiments, the source gas includes a noble gas, for example krypton, neon, argon or helium. In some embodiments, the source gas includes hydrogen. The source gas may be selected as a gas mixture or composition corresponding to the desired output photon wavelength of ionization device 400 to gas sample 405. Through suitable selection of the source gas a variety of emission wavelengths of the plasma 406 could be chosen. For example, helium (He) has an optical resonance emission line at 58.43 nm, emitting photons with energies of 21.22 eV, while krypton (Kr) has lines at 116.49 and 123.58 nm, with corresponding photon energies of 10.64 and 10.03 eV. The emission wavelength can thus be appropriately matched to the desired application. As such, comparatively low-energy photons can be used to ionize large molecules with reduced fragmentation. Alternatively, comparatively high energy photons can be used for molecular fragmentation, or photon energies can be chosen to selectively ionize certain compounds without ionizing others.

The plasma anode 410 and the plasma cathode 411 are connected to an energy source (not shown). The energy source may be configured to provide energy to the source gas in the form of a DC voltage, a pulsed voltage, or an oscillating signal with some appropriate frequency such as RF or microwave to generate and maintain a plasma.

In representative embodiments, cavity 407 is illustratively toroidal. In operation, a source gas is supplied to an inlet port (not shown in FIG. 4A) to generate plasma 406. An electrostatic voltage, either a DC voltage, a pulsed voltage, or and oscillating voltage with some appropriate frequency (e.g., RF or microwave), is delivered between the plasma anode 410 and the plasma cathode 411. The resulting electric field sustains a discharge in plasma 406 that is substantially confined inside cavity 407. Aperture 408 along inner wall 409' of the cavity 407 allows for windowless light (e.g., VUV) emission directed radially inward while restricting the flow of the source gas from plasma 406 such that a pressure differential can be maintained between the inlet 403 and the outlet 404 of the channel 402. Moreover, the electric field established in the axial direction aids in confining plasma ions of plasma 406 within the cavity 407 (i.e., between the plasma anode 410 and the plasma cathode 411).

The magnetic field is oriented radially inward (i.e., perpendicular to the axis of symmetry 421, depicted by arrows 422). This orthogonal orientation of the static electric and magnetic fields creates an EXB-drift wherein movement of the electrons of the plasma 406 is the superposition of a relatively fast circular motion around the guiding center and a relatively slow drift of this point in the direction of EXB (i.e., rotationally about the axis of symmetry 421 as depicted by arrow 423). Stated somewhat differently, the motion of the plasma electrons of plasma 406 is azimuthal with a substantially constant velocity in arcs around the axis of symmetry 421. The magnetic field traps the electrons of the plasma 406 in an EXB drift orbit about the axis of symmetry 421. The plasma electrons ionize the source gas introduced into the cavity 407 and aid in sustaining the plasma 406. The plasma ions created by the plasma electrons are not significantly influenced by the comparatively weak magnetic field, and rather are accelerated by the axial electrostatic force between the plasma anode 410 and the plasma cathode 411, further sustaining the plasma 406.

As described more fully below, in addition to plasma creation, the plasma anode 410 and the plasma cathode 411 serve to confine plasma ions and plasma electrons to the cavity 407 and thus substantially prevent plasma ions and plasma electrons from traveling through the aperture 408 and into the ionization region 417. Similarly, in addition to plasma creation, the inner and outer magnets 414, 412 serve to confine electrons in the cavity and thus substantially prevent plasma electrons from traveling through aperture and into the ionization region. As such, the plasma anode 410 and the plasma cathode 411 in conjunction with the inner and outer magnets 414, 412 function as a deflection device in accordance with a representative embodiment.

The relative orientation of the orthogonal electric and magnetic fields of the ionization device 400 not only functions to create and sustain plasma 406, but also functions to substantially confine the electrons and ions of the plasma 406 within the cavity 407. Because there is no window over aperture 408, there is a potential for leakage of ions and electrons through the aperture 408, into the ionization region 417 and into the channel 402. Such ions and electrons could contaminate the sample gas/ions and result ultimately in inaccurate measurements by the mass spectrometer 100. Beneficially, and as described above, the ions of the plasma 406 are guided strongly by the electric field between the plasma anode 410 and the plasma cathode 411, and are substantially prevented from exiting the aperture 408. The electrons of the plasma 406 are confined in the EXB drift rotationally about the axis of symmetry, and are substantially prevented from exiting through the aperture 408 as well.

Figure 4B:
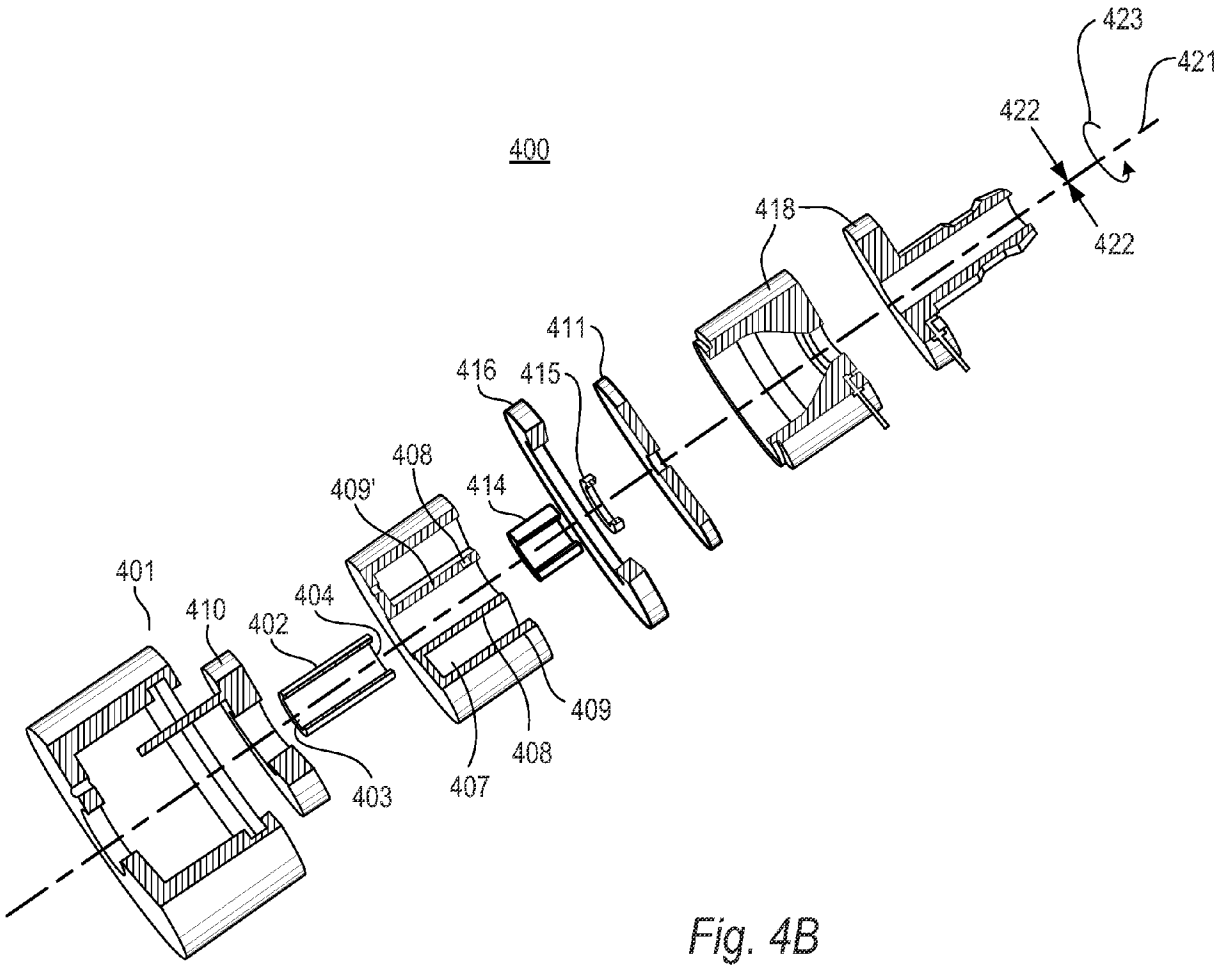
FIG. 4B illustrates a partially exploded partially sectional view of an ionization device in accordance with a representative embodiment.

FIG. 4B illustrates a partially exploded partially sectional view of the ionization device 400 depicted in FIG. 4A. The ionization device 400 comprises housing 401 configured to receive channel 402. The housing 401 and the channel 402 comprise an electrically conductive material such as stainless steel.

A gas sample 405 is provided at the inlet 403. A plasma 406 is created in cavity 407 of structure 409, which substantially encircles the channel 402. The structure 409 is illustratively an electrical insulator (e.g., high-temp plastic or suitable machinable ceramic material) that isolates the cavity 407 from electric fields generated to deflect plasma ions and plasma electrons, and from ion extraction optics 418 to ensure that the electric field in the cavity 407 is axial (i.e., parallel to the axis of symmetry 421). The aperture 408 along inner wall 409' allows photons (e.g., VUV photons) created in the plasma 406 to be incident on the gas sample 405 at the outlet 404 of the channel 402 and to cause photoionization of the gas sample 405.

As depicted in FIG. 4B, cavity 407 is illustratively toroidal. In operation, source gas is supplied to an inlet port (not shown in FIG. 4B) to generate plasma in cavity 407. An electrostatic voltage, either a DC voltage, a pulsed voltage, or and oscillating voltage with some appropriate frequency (e.g., RF or microwave), is delivered between the plasma anode 410 and the plasma cathode 411. The resulting electric field sustains a discharge in plasma 406 that is substantially confined inside cavity 407. Aperture 408 of the cavity 407 allows for windowless light (e.g., VUV) emission directed radially inward (in direction of arrows 422) while restricting the flow of the source gas from plasma 406 such that a pressure differential can be maintained between the inlet 403 and the outlet 404 of the channel 402. Moreover, the electric field established in the axial direction aids in confining plasma ions of plasma 406 within the cavity 407 (i.e., between the plasma anode 410 and the plasma cathode 411).

The magnetic field is oriented radially inward (i.e., perpendicular to the axis of symmetry 421, depicted by arrows 422). This orthogonal orientation of the static electric and magnetic field creates an EXB-drift wherein movement of the electrons of the plasma 406 is the superposition of a relatively fast circular motion around the guiding center and a relatively slow drift of this point in the direction of EXB (i.e., rotationally about the axis of symmetry 421 as depicted by arrow 423). Stated somewhat differently, the motion of the plasma electrons of plasma 406 is azimuthal with a substantially constant velocity in arcs around the axis of symmetry 421. The magnetic field traps the electrons of the plasma 406 in an EXB drift orbit about the axis of symmetry 421. The plasma electrons ionize the source gas introduced into the cavity 407 and aid in sustaining the plasma 406. The plasma ions created by the plasma electrons are not significantly influenced by the comparatively weak magnetic field, and rather are accelerated by the axial electrostatic force between the plasma anode 410 and the plasma cathode 411, further sustaining the plasma 406.

Optional plasma electron deflection electrode 415 is disposed near the outlet 404 of the channel 402. The plasma electron deflection electrode 415 substantially encircles the channel 402 near the outlet 404 as depicted in FIG. 4B. An optional plasma ion deflection electrode 416 is disposed near the outlet 404 of the channel 402 with the ionization region 417 formed between the outlet 404 of the channel 402 and the plasma ion deflection electrode 416. As described above, the plasma electron deflection electrode 415 and the plasma ion deflection electrode 416 may be foregone due to confinement of the plasma ions and plasma electrons in the cavity 407 by the established electric and magnetic fields used to create plasma 406.

Figure 5:
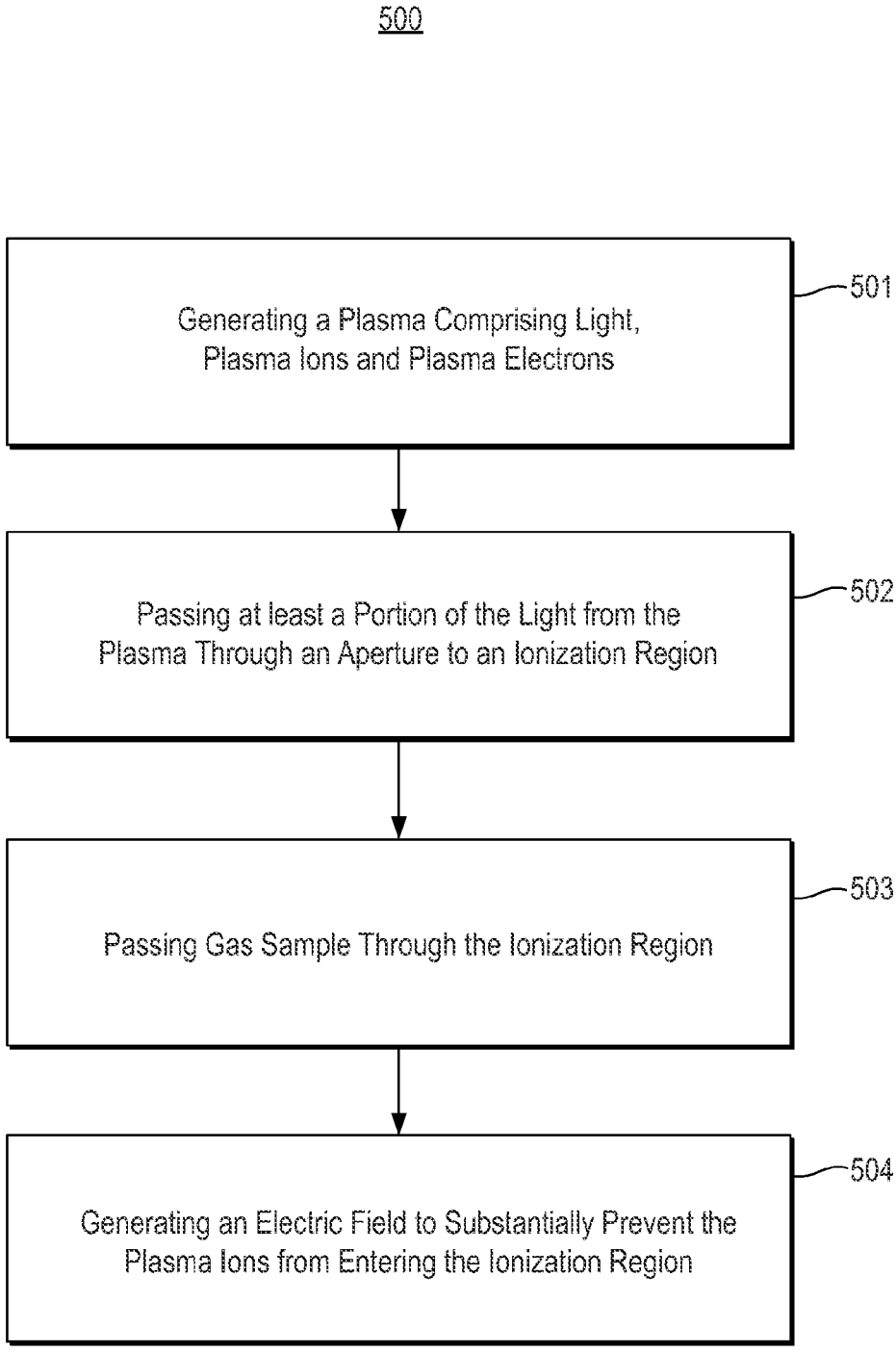
FIG. 5 illustrates a flow chart of a method of exposing a sample gas to an excitation light in accordance with a representative embodiment.

FIG. 5 illustrates a flow chart of a method 500 of exposing a sample gas to an excitation light in accordance with a representative embodiment. The method 500 may be implemented using the ionization devices according to representative embodiments described in connection with FIGS. 1~4B. At 501, the method comprises generating a plasma comprising light, plasma ions and plasma electrons. At 502, the method comprises passing at least a portion of the light from the plasma through an aperture to an ionization region. At 503, the method comprises passing a gas sample through the ionization region. At 504 the method comprises generating an electric field to substantially prevent the plasma ions from entering the ionization region.

While representative embodiments are disclosed herein, one of ordinary skill in the art appreciates that many variations that are in accordance with the present teachings are possible and remain within the scope of the appended claims. The invention therefore is not to be restricted except within the scope of the appended claims.

The invention claimed is:

1. An ionization device, comprising:

a plasma source configured to generate a plasma, the plasma comprising light, plasma ions and plasma electrons, the plasma source comprising an aperture disposed such that at least part of the light passes through the aperture and is incident on a gas sample;

an ionization region; and a plasma deflection device comprising a plurality of electrodes configured to establish an electric field, wherein the electric field substantially prevents the plasma ions from entering the ionization region.

2. An ionization device as claimed in claim 1, wherein the plasma deflection device further comprises a magnet configured to establish a magnetic field, wherein the magnetic field substantially prevents the electrons of the plasma from entering the ionization region.

3. An ionization device as claimed in claim 2, wherein the electric field and the magnetic field are substantially orthogonal.

4. An ionization device as claimed in claim 2, wherein the electric field and the magnetic field are substantially parallel.

5. An ionization device as claimed in claim 2, wherein the electric field and the magnetic field are substantially antiparallel.

6. An ionization device as claimed in claim 2, wherein the electric field is oriented in an axial direction and the magnetic field is oriented in a radial direction.

7. An ionization device as claimed in claim 2, wherein the electric field and the magnetic field are oriented in the radial direction.

8. A mass spectrometer, comprising a mass analyzer, a detector and an ion source, wherein the ion source comprises the ionization device of claim 1.

9. A method of exposing a sample gas to an excitation light, the method comprising:

generating a plasma comprising light, plasma ions and plasma electrons;

passing at least a portion of the light from the plasma through an aperture to an ionization region;

passing a gas sample through the ionization region; and generating an electric field to substantially prevent the plasma ions from entering the ionization region.

10. A method as claimed in claim 9, further comprising generating a magnetic field to substantially prevent the plasma electrons from entering the ionization region.

11. A method as claimed in claim 10, the wherein the electric field and the magnetic field are substantially orthogonal.

12. A method as claimed in claim 10, wherein the electric field and the magnetic field are substantially parallel.

13. A method as claimed in claim 10, wherein the electric field and the magnetic field are substantially antiparallel.

14. A method as claimed in claim 10, wherein the electric field is oriented in an axial direction and the magnetic field is oriented in a radial direction.

15. An ionization device, comprising:

a channel having an inlet end and an outlet end, the inlet end being configured to receive a gas sample;

a plasma source configured to generate light, plasma ions and plasma electrons, the plasma source comprising an aperture disposed such that at least part of the light passes through the aperture and is incident on the gas sample released from the outlet end of the channel;

a plurality of electrodes configured to establish an electric field to guide the plasma ions, wherein the electric field substantially prevents the plasma ions from exiting through the aperture; and a magnet configured to establish a magnetic field to guide the plasma electrons, wherein the magnetic field substantially prevents the plasma electrons from exiting through the aperture and the electric field and the magnetic field are orthogonal.

16. An ionization device as claimed in claim 15, wherein the magnet comprises an outer magnet substantially surrounding the plasma source and an inner magnet substantially surrounding the channel.

17. An ionization device as claimed in claim 15, wherein the electric field is oriented in an axial direction and the magnetic field is oriented in a radial direction.

18. An ionization device as claimed in claim 15, further comprising a plasma ion deflection electrode disposed between the aperture and the channel, wherein the plasma ion deflection electrode is configured to attract or repel plasma ions that passed through the aperture.

19. An ionization device as claimed in claim 15, further comprising a plasma electron deflection electrode disposed between the aperture and the channel, wherein the plasma electron deflection electrode is configured to attract or repel plasma electrons that passed through the aperture.

20. A mass spectrometer, comprising a mass analyzer, a detector and an ion source, wherein the ion source comprises the ionization device of claim 15.

* * * * *

UNITED STATES PATENT AND TRADEMARK OFFICE

CERTIFICATE OF CORRECTION

PATENT NO. : 8,563,924 B2
APPLICATION NO. : 13/170282
DATED : October 22, 2013
INVENTOR(S) : James Edward Cooley et al.

It is certified that error appears in the above-identified patent and that said Letters Patent is hereby corrected as shown below:

In the Claims

In column 12, line 61, In Claim 11, delete "the wherein" and insert -- wherein --, therefor.

Signed and Sealed this
Third Day of June, 2014

Michelle K. Lee

Michelle K. Lee
*Deputy Director of the United States Patent and Trademark Office*